US005657888A

United States Patent [19]

Kröll et al.

[11] Patent Number: 5,657,888

[45] Date of Patent: Aug. 19, 1997

[54] TRACK-BOUND MOBILE CRANE

[75] Inventors: Joachim Kröll, Jüchen; Hermann Franzen, Mönchengladbach; Peter Richter, Bergheim, all of Germany

[73] Assignee: Mannesmann Aktiengesellschaft, Dusseldorf, Germany

[21] Appl. No.: 601,576

[22] Filed: Feb. 14, 1996

[30] Foreign Application Priority Data

Feb. 14, 1995 [DE] Germany ..... 195 06 856.4

[51] Int. Cl.[6] ..... E01B 29/02

[52] U.S. Cl. ..... 212/226; 212/326; 104/3

[58] Field of Search ..... 104/3; 414/543; 212/314, 325, 225, 226, 250

[56] References Cited

U.S. PATENT DOCUMENTS

| | | | |
|---|---|---|---|
| 3,076,559 | 2/1963 | Crile | 212/250 |
| 3,245,551 | 4/1966 | Van Hezik | 212/226 |
| 3,602,375 | 8/1971 | Martinsen | 414/542 |

FOREIGN PATENT DOCUMENTS

| | | | |
|---|---|---|---|
| 5470479 | 3/1932 | Germany | 212/325 |
| 930279 | 7/1955 | Germany | 212/325 |
| 2931421 | 2/1981 | Germany | 212/225 |

*Primary Examiner*—Thomas J. Brahan

*Attorney, Agent, or Firm*—Cohen, Pontani, Lieberman, Pavane

[57] ABSTRACT

A track-bound mobile crane with a vertically-adjustable carrying device arranged on a vehicle frame and to which a guide carrier is attached. The guide carrier consists of two vertically-adjustable columns arranged across from one another at each end of the vehicle on both sides of the vehicle longitudinal axis. The guide carrier can be raised and lowered by the vertically adjustable columns.

6 Claims, 5 Drawing Sheets

TRACK-BOUND MOBILE CRANE

BACKGROUND OF THE INVENTION

1. Field of the Invention

The invention relates to a track-bound mobile crane having a vertically-adjustable carrying device that is arranged on the vehicle frame. A guide carrier is attached to the carrying device so that the guide carrier extends in the longitudinal direction of the mobile crane and has a longitudinally movable trolley of a lifting unit.

2. Description of the Prior Art

Track-bound mobile cranes are used for rail and bridge construction, among other purposes, as well as for rescue work. These cranes must be highly maneuverable even under cramped working conditions. Known devices of the generic type are equipped with short rigid guide carriers, on which it is possible to move trolleys supported with lifting units in the longitudinal direction. The pathways of these trolleys correspond approximately to the length of the vehicle, which results in the working area of the known devices being limited. In particular, it is difficult to pick up and set down loads beside the track of the mobile crane, because the rigid arrangement of the trolley pathway limits the maneuverability of the lifting device.

Track-bound mobile cranes are also known in which upper carriages with crane jibs are arranged rotatably on the center of the lower carriage, as in mobile cranes that can travel on the street. However, the use of such cranes is often difficult or impossible because of conditions at the work site, danger to traffic on neighboring tracks, or overhead contact wires. Furthermore, the handling of loads and the performing of work in tunnel regions, for example, especially on single-track lines, is possible only with great difficulty using known mobile cranes.

SUMMARY OF THE INVENTION

Accordingly, it is an object of the present invention to provide a track-bound mobile crane that makes possible diversified use, especially in areas where space is extremely limited, such as in tunnels or below trolley wires, and also permits loads to be transported from the front of the machine to the rear.

Pursuant to this object, one aspect of the present invention resides in a carrying device consisting of two pairs of vertically-adjustable columns. One of the pairs of columns being respectfully provided at each end of the vehicle. The columns of each pair are arranged across from one another on the sides of the vehicle and are connected to one another by transverse spars on which the guide carrier can run in an adjustable manner parallel and at an angle to the vehicle longitudinal axis. The transverse spars, and thus the guide carrier, can also be raised and lowered by means of the vertical adjustability of the columns.

Using a carrying device according to the present invention, it is possible to raise and lower loads, e.g., containers for scrap, track sections, construction equipment, etc. under severe space restrictions and to transport these loads through the device, from one side to the other, on the guide carrier below the transverse spars, which are designed in a portal-like fashion. By moving the guide carrier to one side of the vehicle or the other, it is even possible to pick up and set down loads that have been placed on the side. The guide carrier can also be slanted relative to the vehicle's longitudinal axis, which expands the movement area of the trolleys. The vertical adjustability of the columns allows the guide carrier, together with the transverse spars supporting it, to be moved from a lower transport position into an upper working position, while maintaining the prescribed safety distance to trolley wires. In this way, a very flexible device is created, which achieves high maneuverability using simple means.

In one embodiment of the invention, in addition to the guide carrier, a guide carrier extension, which corresponds to the dimensions of the guide carrier, is placed on the vehicle frame on each side of the vehicle's longitudinal axis. In the transport position of the mobile crane, these guide carrier extensions can be manipulated and mounted and dismounted with the help of the guide carrier. This embodiment of the invention substantially increases the working area of the mobile crane, because the guide carrier extensions placed frontally on the guide carrier, with the help of the guide carrier and the lifting device, project far beyond the vehicle length on both sides. In the transport position of the mobile crane, the guide carrier extensions are placed on the carriage. The extensions can be picked up with the guide carrier and moved into the position where they will be connected to the guide carrier. By swinging the guide carrier on its transverse spars, the flange-mounted and bolted guide carrier extensions, which project on both sides, can be swung out from the vehicle longitudinal axis with their free ends. As a result, these extensions are able to easily pick up loads placed beside the track and to transport them into the area of the carriage or through the vehicle to the other side. A mobile crane is thus created which, without requiring additional space (as is needed, for example, by swingable load pickup means), permits loads picked up in front of the machine to be transported to the rear of the machine to be set down. Serving as the lifting device is a lifting mechanism arranged centrally in the guide carrier, as applicable, in connection with the transverse spars which bear the guide carrier and can be raised and lowered by means of the vertically-adjustable columns. The horizontal movement of the trolley is preferably carried out by a cable winch, which is mounted in an end area of the guide carrier. So that the lifting and movement cables of the trolley do not have to be moved in and out completely during each mounting and dismounting, the cables are designed to be separable in the end area of the guide carrier.

To store the guide carrier extension during transport of the mobile crane, there are freely carried brackets on the vehicle frame. In the area of the columns, these brackets, mounted around vertical axes, can be swung out of their active position, which is at a right angle to the vehicle's longitudinal axis, into a resting position, which is parallel to the vehicle's longitudinal axis. By swinging these brackets into the resting position, the passageway area for the load on the guide carrier is substantially enlarged, so that even large loads can be easily transported without obstruction through the vehicle with the help of the trolley.

In a further embodiment of the invention, the guide carrier encompasses the transverse spars with window-like openings provided at its end regions. This design allows the structural height of the mobile crane to be reduced and at the same time creates an advantageous bearing between the guide carrier and the transverse spars.

Preferably, to move the guide carrier crosswise, linear driving means are connected between the transverse spars and the guide carrier. According to another embodiment of the invention, these driving means may be piston-cylinder units.

The mobile crane according to the invention can be used in an economical fashion due to its advantageous mounting options and the short rigging time resulting therefrom. A process for rigging a mobile crane according to the invention is characterized by the following process steps:

a) The transverse spars, together with the guide carrier, are lifted into an upper final position by vertically adjusting the columns;

b) the guide carrier is moved crosswise on the transverse spars parallel to the vehicle longitudinal axis into a position over one of the guide carrier extensions;

c) the guide carrier extension is coupled to the guide carrier and is moved, by crosswise movement of the guide carrier on the transverse spars, into the center of the vehicle frame;

d) with the help of the trolley, the guide carrier extension, which has struck against the trolley, is moved in the direction of its longitudinal extension and placed, as applicable, on movable supports;

e) steps a) to d) are repeated with the other guide carrier extension, which is moved toward the side opposite to the first guide carrier extension; and f) the supports with the two guide carrier extensions are moved back and the transverse spars, together with the guide carrier, are moved by vertical adjustment of the columns into a position where the lifting and movement cables of the trolley are coupled and the faces of the guide carrier extensions and the guide carrier are bolted together.

The inventive process permits the mobile crane to be rigged in an extremely confined area and in an extremely short time. All necessary resources are arranged on the vehicle frame and can be manipulated with the help of the trolley on the guide carrier.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1A:
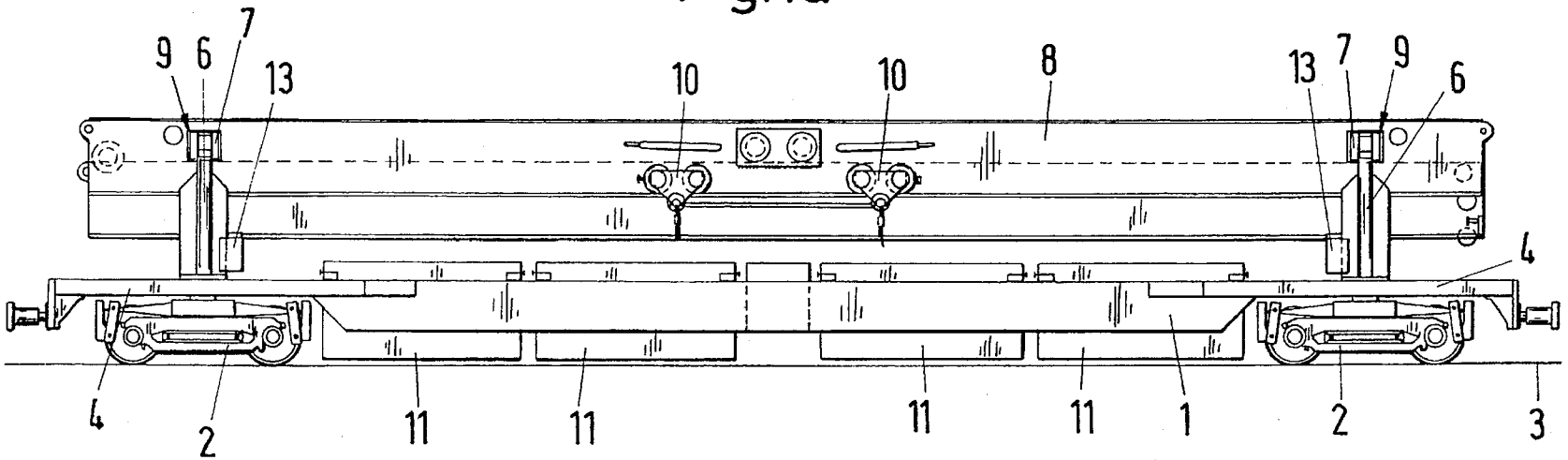
FIG 1*a* is a side view of the track-bound mobile crane according to the invention in the transport position.
Figure 1B:
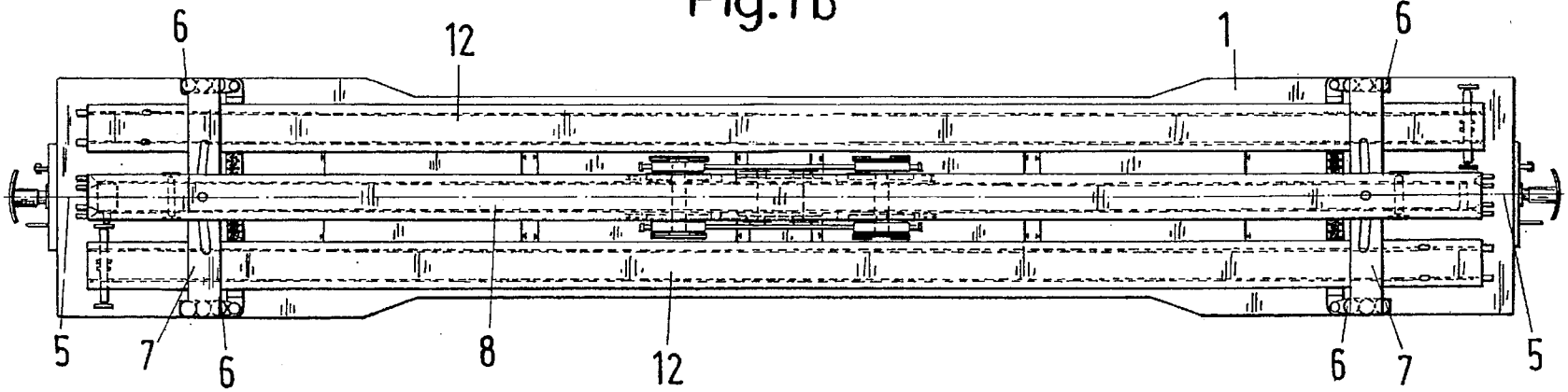
FIG. 1*b* is a top view of the crane of FIG. 1*a;*

FIGS. 1*a* and 1*b* show the vehicle frame 1 of the mobile crane according to the invention. The vehicle frame 1 can be moved on tracks 3 by carriages 2. At both ends 4 of the vehicle vertically-adjustable columns 6 are arranged on the vehicle frame on both sides of the vehicle longitudinal axis 5 and preferably centered relative to the carriages 2. The columns 6 at each respective end of the vehicle are connected to one another in pairs at their respective upper ends by transverse spars 7. A guide carrier 8 runs on the transverse spars 7, specifically, in windows 9 that pierce crosswise through the guide carrier 8, and encompass the transverse spars 7. A trolley 10 is movable on the guide carrier 8. The trolley 10 will be described in greater detail below. Containers 11, for example, which can be used to transport scrap or construction materials in a manner to be described more closely below, are suspended in the vehicle frame 1.

FIGS. 1*a* and 1*b* show the transport position of the mobile crane. In FIG. 1*b*, two guide carrier extensions 12 are placed on the vehicle frame laterally next to the guide carrier 8. These guide carrier extensions 12 are placed on brackets 13, which can better be seen in FIG. 2.

Figure 2:
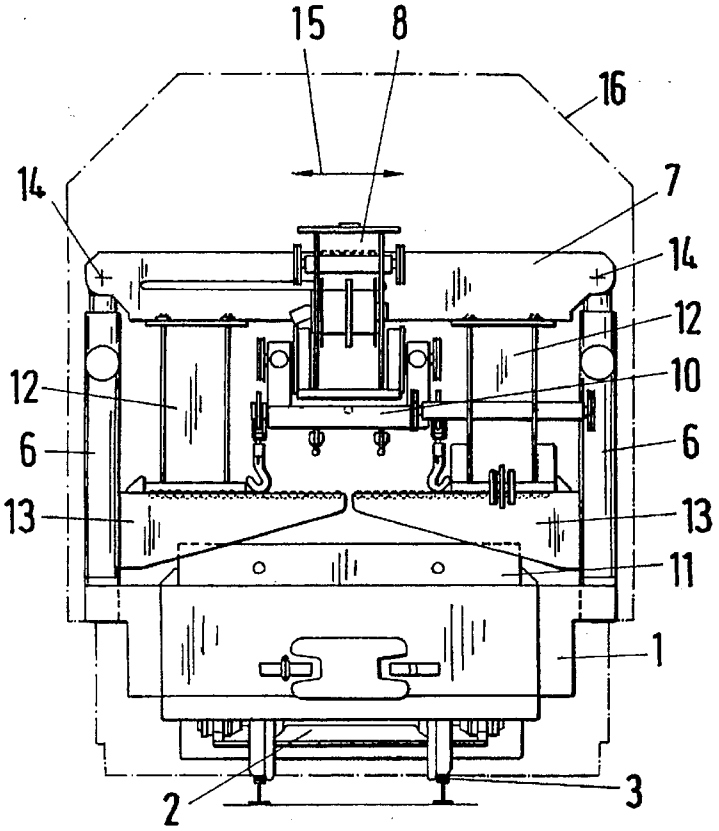
FIG. 2 is a cross-section through the mobile crane in FIG. 1*a* in the area of the trolley.

FIG. 2 shows the vertically-adjustable columns 6 as well as the transverse spars 7 attached in a hinged manner to the columns 6 at a point 14. The guide carrier 8 can be moved on the transverse spar 7 in the direction of arrow 15. The trolley 10 can be moved on the guide carrier 8 orthogonal to the plane of the drawing. In the drawing, which shows the transport position, the guide carrier extensions 12 are placed on the brackets 13 on both sides of the guide carrier 8. One of the containers 11 can be seen suspended in the vehicle frame 1. The entire mobile crane is located inside a defined area 16, which is indicated by the dot-dashed line.

Figure 3:
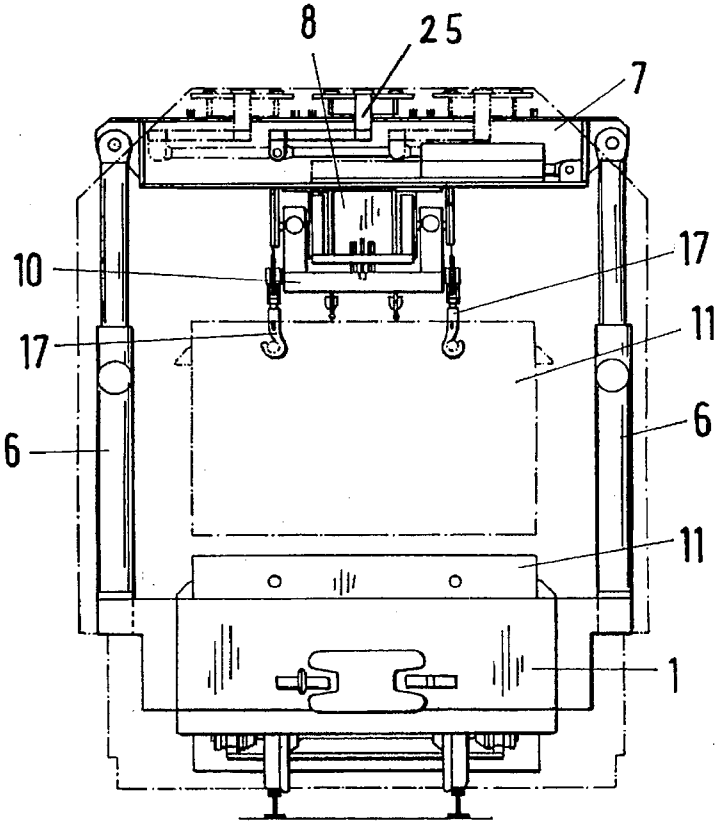
FIG. 3 is a cross-section through the mobile crane according to the invention in the working position.

FIG. 3 shows the working position of the mobile crane, with the vertically-adjustable columns 6 in their telescoped position. The transverse spar 7 is located in its upper position and has lifted the guide carrier 8 into its working position. In this position, the trolley 10 is able to pick up the container 11 (shown in dot-dashed lines) with hooks 17 and transport it vertically relative to the plane of the drawing through the space formed by the two columns 6, the vehicle frame 11 and the transverse spar 7.

Figure 4A:
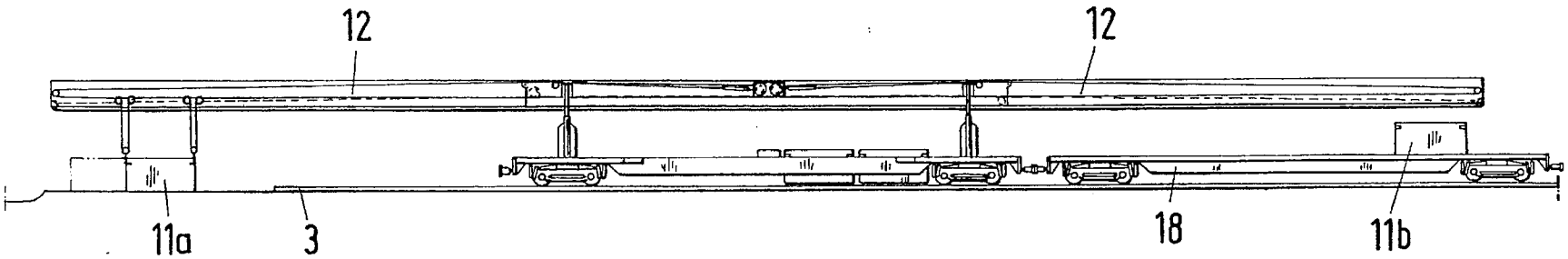
FIG. 4*a* is a side view of the working area of the mobile crane according to the invention.
Figure 4B:
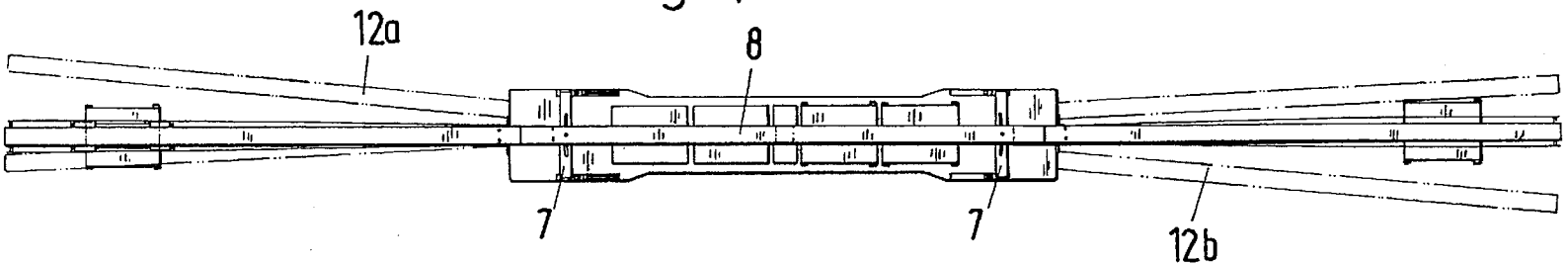
FIG. 4*b* is a top view of the crane of FIG. 4*a;*

FIG. 4*a* is a side view of the rigged mobile crane and shows that a container 11*a* can be picked up from a location far in front of the mobile crane and transported through the crane into the position of a container 11*b*. This may be located, for example, on the loading platform of a transport car 18, over which one of the guide carrier extensions 12 projects. As seen in FIG. 4*b*, the other guide carrier extension 12 can be swung into the dot-dashed positions 12*a* and 12*b* by simultaneous crosswise and slanting movement of the guide carrier 8 on the transverse spars 7, so that it is also possible to pick up loads outside of the track 3.

The rigging process of the mobile crane is described below in reference to the series of FIGS. 5*a*–5*e* and FIGS. 6*a*–6*c*.

Figures 5A, 5B, 5C, 5D, 5E:
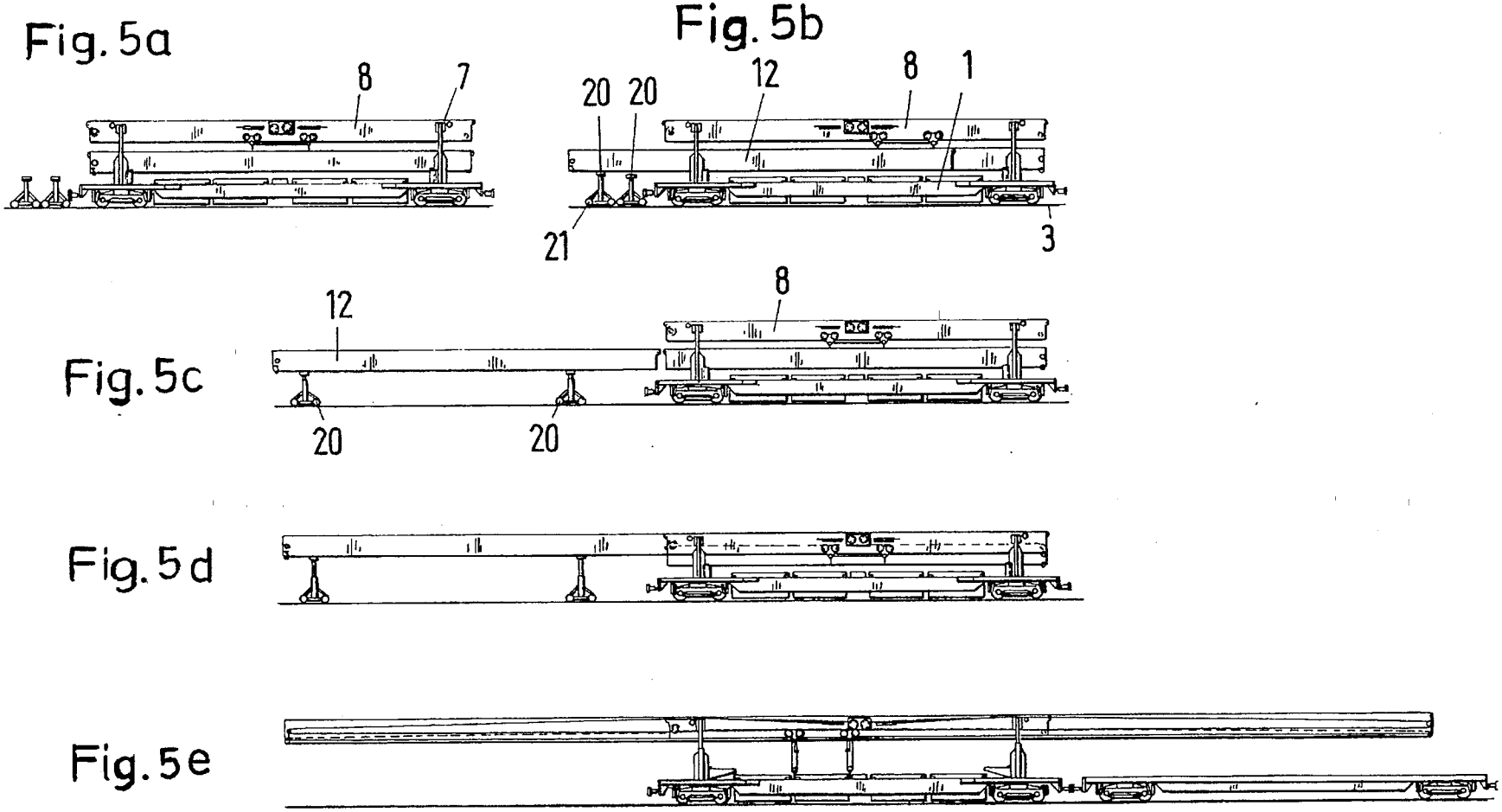
FIGS. 5*a*–5*e* illustrate the process steps for rigging the track-bound mobile crane according to the invention, in a side view.
Figure 6C:
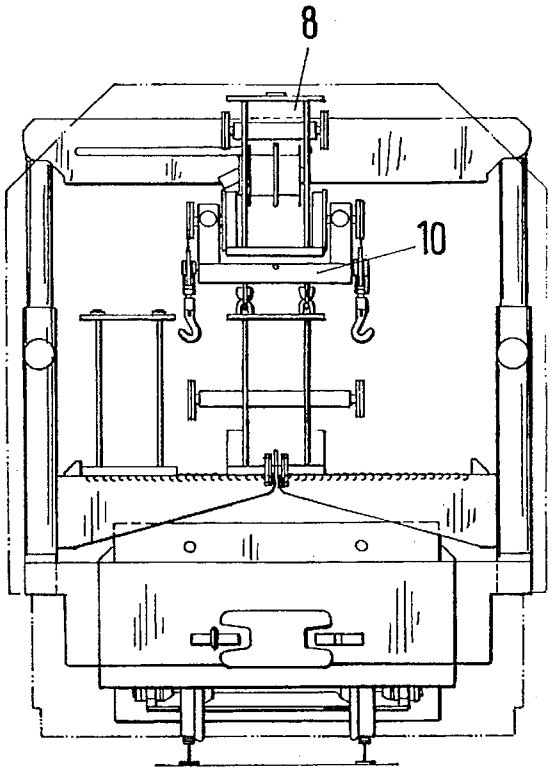
FIGS. 6*a*–6*c* illustrate the process steps for rigging the track-bound mobile crane according to the invention, in cross-section.
Figure 6B:
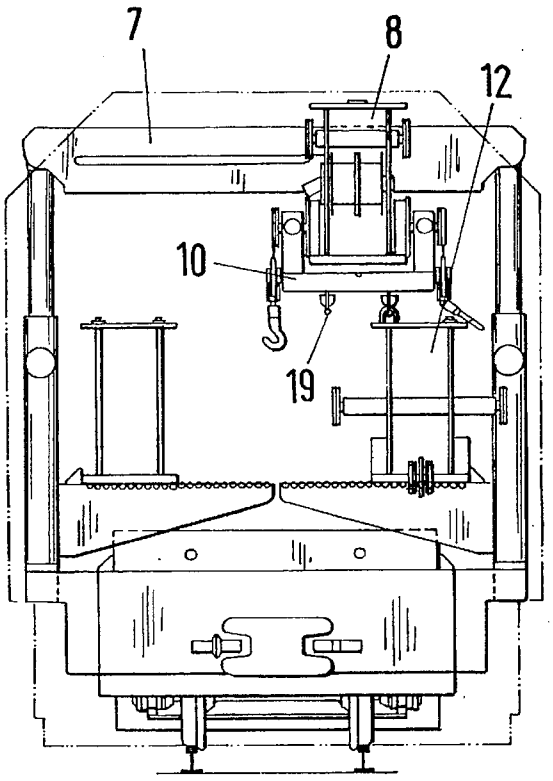
Figure 6A:
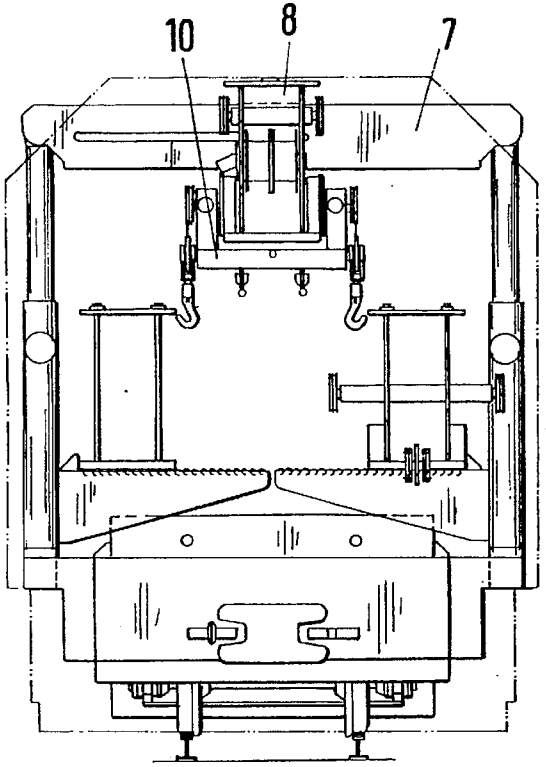

In the initial position shown in FIG. 2, the transverse spars 7 are in the lowered position, and the guide carrier extensions 12 rest on the brackets 13 on both sides of the guide carrier 8. By vertical adjustment of the columns 6, the transverse spars 7, together with the guide carrier 8, are lifted into an upper final position, as shown in FIGS. 5*a* and 6*a*. By moving the guide carrier 8 laterally with the help of linear driving means (such as piston-cylinder units 25 attached between the guide carrier and the transverse spar) toward the right in the plane of the drawing, the trolley 10 is moved above the right-hand guide carrier extension 12 and the carrier extension 12 strikes the coupling means 19, as shown in FIG. 6*b*. In the position shown in FIG. 6*c*, i.e., after the guide carrier 8 is moved back into the center of the vehicle, the trolley 10 is moved perpendicularly relative to the plane of the drawing, whereby, as shown in FIG. 5*b*, the guide carrier extension 12 is pushed out of the region of the vehicle frame 1. The freely projecting part of the guide carrier extension 12 is placed on supports 20, which are provided with wheels 21 and roll on the track 3. As shown in FIG. 5*c*, the guide carrier extension 12 is placed on both supports 20.

As described with reference to FIGS. 5*a* to 5*d*, the left-hand guide carrier extension 12 (FIG. 6) is now picked up by the guide carrier 8 and transported toward the opposite side of the guide carrier 8, out of the region of the vehicle frame 1, and is also placed upon supports 20.

The guide carrier 8 is now—as applicable, after the guide carrier extensions 12 have been moved into the proper position through movement of the supports 20—lowered into a position where the faces of the guide carrier 8 and the guide carrier extensions 12 lie directly across from one another. To this end, the columns 6 are moved in, as a result of which the transverse spars 7, together with the guide carrier 8, reach the desired lowered position. In this position, the lifting and movement cables of the trolley 10 are coupled and the guide carrier 8 and the guide carrier extensions 12 are connected to one another. As needed, it is also possible for the vertical position of the supports 20 to be adjusted to the mounting position of the guide carrier 8 and the guide carrier extensions 12. Subsequently, the guide carrier 8, together with the guide carrier extensions 12, is lifted into the working position by moving out the columns 6, and the mobile crane is ready for use.

FIG. 5*e* shows the completely rigged position of the two guide carrier extensions 12 and the guide carrier 8, as is shown again in FIG. 4. The derigging of the mobile crane according to the invention is carried out in the reverse order, until the transport position of the mobile crane according to FIG. 2 is reached.

The invention is not limited by the embodiments described above which are presented as examples only but can be modified in various ways within the scope of protection defined by the appended patent claims.

I claim:

1. A track-bound mobile crane, comprising:

a vehicle frame having a longitudinal axis;

a vertically-adjustable carrying device arranged on the vehicle frame;

a guide carrier attached to the carrying device and extending in the longitudinal direction of the vehicle frame;

a movable trolley arranged on the guide carrier so as to be movable in the longitudinal direction, the carrying device including two pairs of vertically-adjustable columns, each pair of columns being mounted on a respective end of the vehicle frame, arranged across from one another on opposite sides of the longitudinal axis and connected together by a transverse spar, the guide carrier being arranged to run on the transverse spars in an adjustable manner parallel and at an angle to the longitudinal axis and to be raisable and lowerable by the columns; and two guide carrier extension members that correspond to dimensions of the guide carrier and are mounted to the vehicle frame next to the guide carrier so that one guide carrier extension member is on each side of the vehicle longitudinal axis in a transport position of the mobile crane and so that the guide carrier extension members can be manipulated, mounted and dismounted by the guide carrier.

2. A track-bound mobile crane as defined in claim 1, and further comprising brackets mounted on the vehicle frame so as to freely project and hold the guide carrier extension members in the transport position, the freely-projecting brackets being mounted to the frame in a region of the columns so as to be swingable about a vertical axis between the transport position in which the brackets are at a right angle to the longitudinal axis and a resting position parallel to the longitudinal axis.

3. A track-bound mobile crane as defined in claim 1, wherein the guide carrier has window-like openings in its end regions, the transverse spars being arranged to pass through the window-like openings of the guide carrier.

4. A track-bound mobile crane as defined in claim 1, and further comprising linear driving means attached between the transverse spars and the guide carrier for moving the guide carrier crosswise to the vehicle longitudinal axis.

5. A track-bound mobile crane as defined in claim 4, wherein the linear driving means includes piston-cylinder units.

6. A process for mounting a track-bound mobile crane having a vehicle frame having a longitudinal axis, a vertically-adjustable carrying device arranged on the vehicle frame, a guide carrier attached to the carrying device and extending in the longitudinal direction of the vehicle frame; and a movable trolley arranged on the guide carrier so as to be movable in the longitudinal direction, the carrying device including two pairs of vertically-adjustable columns, each pair of columns being mounted on a respective end of the vehicle frame, arranged across from one another on opposite sides of the longitudinal axis, and connected together by a transverse spar, the guide carrier being arranged to run on the transverse spars in an adjustable manner parallel and at an angle to the longitudinal axis and to be raisable and lowerable by the columns, and two guide carrier extension members that correspond to dimensions of the guide carrier and are mounted to the vehicle frame next to the guide carrier so that one guide carrier extension member is on each side of the vehicle longitudinal axis in a transport position of the mobile crane and so that the guide carrier extension members can be manipulated, mounted and dismounted by the guide carrier, the process comprising the steps of:

a) raising the transverse spars, together with the guide carrier, into an upper final position by vertically adjusting the columns;

b) moving the guide carrier crosswise on the transverse spars parallel to the vehicle longitudinal axis into a position over one of the guide carrier extension members;

c) coupling the guide carrier extension member to the guide carrier and moving the coupled extension member crosswise with the guide carrier on the transverse spars into the center of the vehicle frame;

d) moving the guide carrier extension member in the direction of its longitudinal extension with the trolley that has struck against the guide carrier extension member, and, placing the extension member on moveable supports;

e) repeating steps a) to d) with the other guide carrier extension member, whereby this guide carrier extension member is moved toward the side opposite to the one guide carrier extension member;

f) moving back the supports and lowering the transverse spars, together with the guide carrier, by vertically adjusting the columns into a position in which lifting and movement cables of the trolley are coupled; and g) bolting together faces of the guide carrier extension members and the guide carrier.

* * * * *